United States Patent [19]

Cancel

[11] 4,411,099

[45] Oct. 25, 1983

[54] SINGING ELECTRONIC FROG

[76] Inventor: Radames Cancel, 35-50 81st St., Apt. 2-K, Jackson Heights, N.Y. 11372

[21] Appl. No.: 348,220

[22] Filed: Feb. 12, 1982

[51] Int. Cl.[3] ..... A63H 33/26

[52] U.S. Cl. ..... 46/232; 46/129

[58] Field of Search ..... 46/232, DIG. 1, 117, 46/118, 226, 227, 228, 129, 123, 175 R, 145, 146

[56] References Cited

U.S. PATENT DOCUMENTS

| | | | |
|---|---|---|---|
| 1,024,314 | 4/1912 | Denlinger | 46/129 |
| 1,997,127 | 4/1935 | Stewart | 46/123 X |
| 2,885,824 | 5/1959 | Lemelson | 46/118 |
| 3,162,980 | 12/1964 | Hellman | 46/232 |
| 3,190,037 | 6/1965 | Giordano | 46/227 |
| 3,538,638 | 11/1970 | Glass et al. | 46/232 |

*Primary Examiner*—Mickey Yu

*Attorney, Agent, or Firm*—Richard L. Miller

[57] ABSTRACT

An electronic, sound producing toy in the shape of a frog; including a stationary base and an upwardly pivotable body so as to break a circuit of a battery powered sound system, a rubberband to pivot the body upward while loop pile fastener elements retards the pivoting action.

3 Claims, 5 Drawing Figures

SINGING ELECTRONIC FROG

This invention relates generally to electronic toys.

BACKGROUND OF THE INVENTION

It is well known that in a far past, toys such as frogs have been designed with a body pivoted on hind legs that rest upon a supporting surface so that when the body is freed from a slowly-releasing pitch in order to pivot upwardly, the frog does various tricks.

SUMMARY OF THE INVENTION

It is an object of the present invention to provide a toy frog which includes modern electronic equipment therein so that when the body of the frog is upwardly pivoted on its hind legs an electric circuit of the equipment therein is deactivated so that the equipment stops functioning.

Another object is to provide an electronic frog wherein the interior equipment comprises a sound system that produces a frog-croaking sound or other sound as might be desired.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appending claims.

BRIEF DESCRIPTION OF THE DRAWING FIGURES

The figures on the drawings are briefly described as follows.

DETAILED DESCRIPTION OF THE PREFERRED EMBODIMENT

Figure 1:
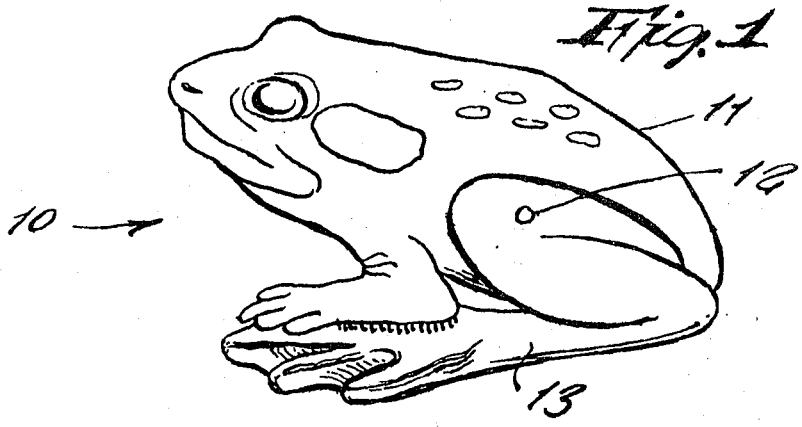
FIG. 1 is a side perspective view of the invention.
Figure 2:
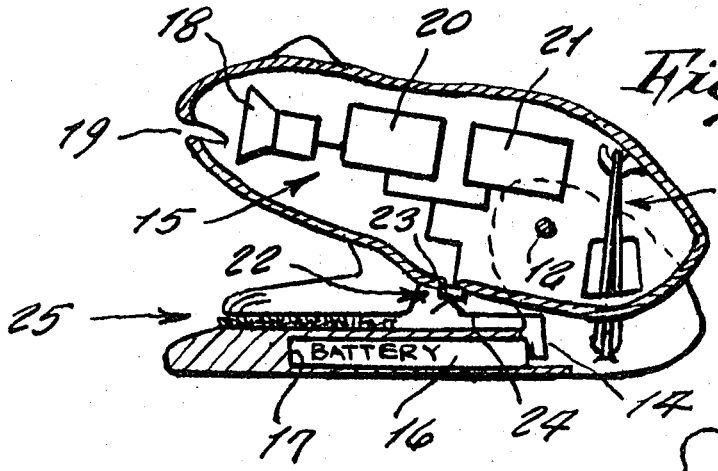
FIG. 2 is a side cross sectional view thereof showing the operative mechanism therewithin; the device being shown with the electric circuit in an operative position.

Referring now to the drawing in greater detail, the reference numeral 10 represents a singing electronic frog, according to the present invention, wherein there is a frog-shaped, hollow body 11 which by means of a transverse pivot pin 12 is pivotally mounted upon a hollow base 13 that is in the shape of a frog's hind legs.

In the present invention, an electronic circuit 14 inside the frog, includes a sound system 15 inside the body and a replaceable dry cell battery 16 inside a chamber 17 of the base. The sound system comprises a speaker 18 aimed at an opening 19 in the body 11 and which represents a frog's mouth, the system further comprising an amplifier 20, and a sound-producing oscillator 21. A switch 22 of the circuit 14 includes a contact 23 on the body and a contact 24 on the base which separate from each other when the body is upwardly pivoted on the pivot pin 12, so as to break the circuit and stop a frog croaking or singing sound produced by the system.

In the present invention, a means 25 is provided for temporialy retaining the body in a downwardly pivoted position so that the sound is in the meantime being produced. There is also provided a means 26 for urging the body to be upwardly pivoted. The means 25 includes two strips 27 and 28 of interlocking loop pile fasteners, one of which is rigidly affixed throughout the length on the base while the other at one end 29 is affixed to the body and at its other end 30 is affixed to the base, so that in use, the strip 28 is gradually peeled off the strip 27.

Figure 3:
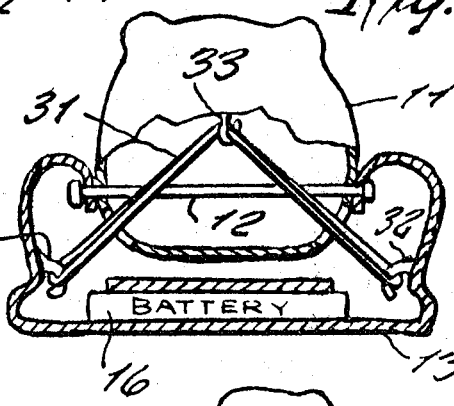
FIG. 3 is a rear elevational view thereof shown partly broken away so as to illustrate a springing mechanism thereof.

The means 26 comprises a rubber band 31 which at opposite ends is hooked around hooks 32 on the base, and which at its center is hooked around a hook 33 of the body, as shown in FIG. 3. The rubberband is located rearwardly of the pivot pin 12 while the retaining means 25 are forwardly of the pivot pin 12, so that the rubberband force causes the strips 27 and 28 to peel apart.

Figure 4:
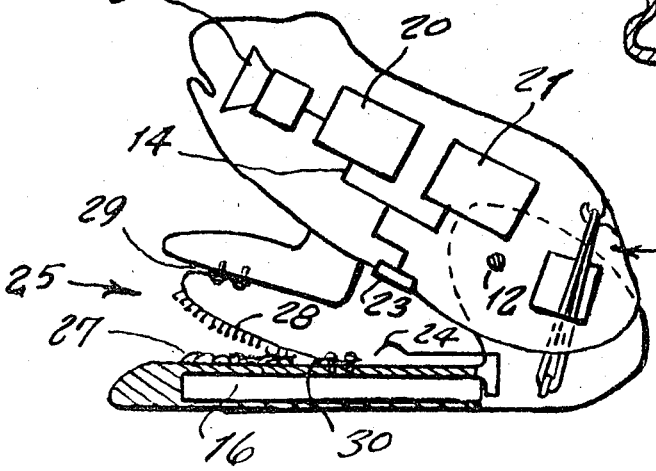
FIG. 4 is a diagrammatic side view thereof shown with the circuit in a disconnected position.
Figure 5:
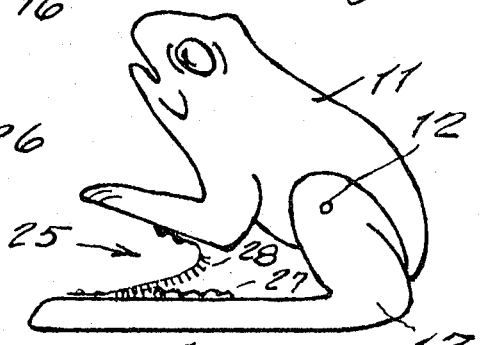
FIG. 5 is a diagrammatic side view of a modified form of the invention also shown with the circuit disconnected.

As shown in FIG. 4 the peeling apart of the strips 27 and 28 is progressively rearwardly in a direction toward the pivot pin, whereas in FIG. 5, another design thereof is shown wherein the peeling action is in a forwardly direction away from the pivot pin. In the former, the peeling force accordingly is strongest at its end whereas in the latter the peeling force is strongest at a start. The peeling apart action in both designs is along a curve.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. A singing electronic frog, comprising in combination, a base in the shape of a frog's hind legs, a body in the shape of an upper torso of a frog, said body being pivoted on said base, an electronic circuit in said frog including a sound producing system, means to open said circuit when said body is upwardly pivoted away from said base, force element means for biasing said body away from said base, and mating alined juxtaposed loop pile fastener elements secured to said body and said base for restraining said biasing force element means.

2. The combination as set forth in claim 1, wherein said forced element means includes a rubberband between said base and body so as to cause said body to be upwardly pivoted.

3. The combination as set in claim 2, wherein a restraining biasing force element means between said base and body exerts a gradually diminishing force to permit said rubberband pivoting said body upwardly away from said base.

* * * * *